US008408127B2

(12) United States Patent
Nielsen

(10) Patent No.: US 8,408,127 B2
(45) Date of Patent: Apr. 2, 2013

(54) DOCTOR BLADE CHAMBER

(75) Inventor: Mikkel Qvist Nielsen, Odense SV (DK)

(73) Assignee: Tresu A/S, Bjert (DK)

( * ) Notice: Subject to any disclaimer, the term of this patent is extended or adjusted under 35 U.S.C. 154(b) by 0 days.

(21) Appl. No.: 12/994,360

(22) PCT Filed: May 18, 2009

(86) PCT No.: PCT/DK2009/050112

§ 371 (c)(1),
(2), (4) Date: Nov. 23, 2010

(87) PCT Pub. No.: WO2009/140969

PCT Pub. Date: Nov. 26, 2009

(65) Prior Publication Data

US 2011/0061550 A1 Mar. 17, 2011

(30) Foreign Application Priority Data

May 23, 2008 (DK) ..... 2008 00715

(51) Int. Cl.
*B41F 31/02* (2006.01)

(52) U.S. Cl. ..... 101/350.6; 101/364

(58) Field of Classification Search ..... 101/350.6, 101/366, 364, 350.1, 157, 169; 118/261
See application file for complete search history.

(56) References Cited

U.S. PATENT DOCUMENTS

| | | | | |
|---|---|---|---|---|
| 5,103,732 | A | 4/1992 | Wells et al. | |
| 6,289,807 | B1 * | 9/2001 | Kutzner et al. | 101/350.1 |
| 7,219,603 | B2 | 5/2007 | Ishikawa | |
| 2002/0083857 | A1 * | 7/2002 | Bardet et al. | 101/480 |
| 2007/0062387 | A1 * | 3/2007 | Percivalle | 101/157 |

FOREIGN PATENT DOCUMENTS

| | | | |
|---|---|---|---|
| EP | 0 180 075 | A2 | 5/1986 |
| WO | 2007/034191 | A2 | 3/2007 |
| WO | 2007/034191 | A3 | 3/2007 |

* cited by examiner

*Primary Examiner* — Judy Nguyen
*Assistant Examiner* — Leo T Hinze
(74) *Attorney, Agent, or Firm* — Roberts Mlotkowski Safran & Cole, P.C.; David S. Safran

(57) ABSTRACT

A method for mounting and dismounting a doctor blade chamber in a support holder on a printing unit as well as an apparatus in which the doctor blade chamber is placed in the support holder in a mounting position and subsequently is brought in contact with a roller, preferably, an anilox roller, in a position of operation. The method and the apparatus advantageously have the doctor blade chamber disposed with the opening upwards in the support holder, preferably in a horizontal position or in a position at such a small angle that ink does not run out of the doctor blade chamber, and is brought into a position under the roller, after which the doctor blade chamber is brought into contact with the roller and pivoted about an axis coinciding with the rotary axis of the roller, into the position of operation.

7 Claims, 6 Drawing Sheets

DOCTOR BLADE CHAMBER

BACKGROUND OF THE INVENTION

1. Field of the Invention

The present invention concerns a method for mounting and dismounting a doctor blade chamber in a support holder on a printing unit, where the doctor blade chamber is placed in the support holder in a mounting position and subsequently is brought in contact with a roller, preferably an anilox roller, in a position of operation. The invention furthermore concerns an apparatus including a doctor blade chamber and a support holder on a printing unit, where the doctor blade chamber is provided with fixing means for fixing in the support holder in a mounting position and subsequently in a position of operation wherein the doctor blade chamber is in contact with a roller, preferably an anilox roller.

2. Description of Related Art

It is commonly known that in connection with printing units a so-called doctor blade chamber is used from which ink/glue/varnish is applied to a roller, typically an anilox roller. In the following the term "ink" will be used as an expression for the various media normally applied with a doctor blade chamber, why this term is to be construed broadly and not exclusively as ink in the actual sense. Moreover, the ink is transferred from the anilox roller to a printing cylinder on which an actual plate is mounted as the anilox roller is in contact with the printing cylinder. Between the printing cylinder and a counterpressure cylinder, the medium on which printing is performed is conducted, typically as a web. This printing method is commonly called flexo printing.

In principle, a doctor blade chamber is a container for ink upon which is mounted two doctor blades at an angle, and which by their free edges bear on the outer surface of the anilox roller. On the surface, the anilox roller is provided with a number of indentations called cups in which ink is received from the doctor blade chamber. The function of the doctor blades is to seal and to scrape excess ink off the surface of the anilox roller, respectively, such that ink is present in the cups in the surface of the roller and not in the areas between the cups. This type of doctor blade chambers are commonly known, and ink is supplied either via a pump at a suitable flow rate or as an ample amount, where additionally supplied either via a pump at a suitable flow rate or as an ample amount, where additionally there is an overflow by which excessively supplied ink is returned to a container. Alternatively, the doctor blade chamber is refilled manually with a pitcher or in other suitable ways, which is particularly advantageous in the production of small series.

In order for the doctor blade chamber to operate optimally, it is typically mounted at the side of the anilox roller at an angle of about 90° relative to vertical, and by change of ink or cleaning, the doctor blade chamber is pivoted about a horizontal axis such that the opening between the doctor blades face upwardly. Prior to this pivoting of the doctor blade chamber, the ink present in the doctor blade chamber may advantageously be emptied, as the ink otherwise will spill when the doctor blade chamber is pivoted out of its contact with the anilox roller. One way of preventing spilling is to empty the ink out through an overflow and subsequently pump flushing water through the doctor blade chamber before releasing it from the roller and turning it away from it.

This problem of unused ink to be emptied out of the doctor blade chamber or being wasted is attempted solved by a solution where a slide gate is inserted between the doctor blades and the surface of the anilox roller. By this solution, however, there is still a minor waste of ink, and at the same time it is necessary to adapt the printing unit such that there is less space for inserting this gate by sliding, which is to be inserted from the end of the roller and thus requiring free space in longitudinal direction of the roller corresponding to the length of the roller.

None of these methods are optimal, and they have several drawbacks as such process steps of emptying ink, flushing or inserting/sliding a gate is time-consuming and/or tedious, with a consequently more expensive process.

SUMMARY OF THE INVENTION

It is thus the object of the invention to indicate a method for mounting and dismounting a doctor blade chamber and to indicate a doctor blade chamber and a mounting device for it, allowing faster change of ink and/or replacement of doctor blade chamber or printing roller.

As mentioned in the introduction and in the preamble of claim 1, the present invention concerns a method for mounting and dismounting a doctor blade chamber in a support holder on a printing unit, where the doctor blade chamber is placed in the support holder in a mounting position and subsequently is brought in contact with a roller, preferably an anilox roller, in a position of operation. The invention furthermore concerns an apparatus including a doctor blade chamber and a support holder on a printing unit, where the doctor blade chamber is provided with fixing means for fixing in the support holder in a mounting position and subsequently in a position of operation wherein the doctor blade chamber is in contact with a roller, preferably an anilox roller.

The new feature of the method and the apparatus is that the doctor blade chamber is disposed with the opening upwards in the support holder, preferably in a horizontal position or in a position at such a small angle that ink does not run out of the doctor blade chamber, and is brought into a position under the roller, after which the doctor blade chamber is brought into contact with the roller and pivoted about an axis coinciding with the rotary axis of the roller, into the position of operation. This pivoting movement can be performed in that the support holder is provided with mounting means, preferably one or more mounting grooves for receiving the fixing means of the doctor blade chamber which are preferably constituted by guide pins on the doctor blade chamber, where these mounting means are made with a shape which is at least part of a circle, where the centre of this circle coincides with the rotary axis of the roller.

It is thus possible to mount a doctor blade chamber in which e.g. ink has been filled already, without spilling any ink during the mounting. This is achieved by placing the doctor blade chamber in the support holder with the opening upwards, after which the doctor blade chamber is brought in contact with the surface of the roller with a slight elevating and/or pivoting movement, and is fixed in this position. The blades and end seals of the doctor blade chamber are hereby brought into contact with the roller, and this may be turned without effort into operative position at a suitable angle at the side of the roller. This operation may easily be performed since the roller e.g. may be free-running, thus only making very light resistance.

The position of operation for the doctor blade chamber at the side of the roller is preferred as the ink in this way flows by itself towards the roller when the latter is rotated relative to the doctor blade chamber. Thus there is no need for a pump to ensure that ink is always present in the doctor blade chamber. A manual refilling may thus be sufficient. Thus there are no pump stations or hoses which are filled with the ink in question, and change of ink may therefore be performed very rapidly.

In a preferred embodiment of a method and an apparatus according to the invention, the doctor blade chamber is provided with guide means, preferably guide pins, which interact with corresponding guide means, preferably mounting grooves, in the support holder. These guide means may advantageously be cylindric guide pins, and the corresponding mounting grooves may be with a width allowing the guide pins to be displaced in the groove with only a modest tolerance. When the doctor blade chamber is in contact with the roller, this will be spring-biased to some degree as the doctor blades act resiliently, thereby contributing to the doctor blade chamber being securely fixed in the mounting groove. When the doctor blade chamber is turned to the desired operative position, it is locked by one or two lock pins which are preferably constituted by spring-biased pins that are displaced into the mounting grooves, either bearing on guide pins or engaging a recess on the doctor blade chamber itself. There may possibly be different positions in which the doctor blade chamber can be fixed.

In a particularly preferred variant of a method and an apparatus according to the invention, the doctor blade chamber is provided with a removable lid, where the lid preferably is provided with a carrying handle and where the lid is used during transport and during storage of the doctor blade chamber. By such a solution it is possible that a doctor blade chamber with ink is put into storage after ending use thereof, without having to empty and clean it. This is a particularly great advantage as small series may thus be produced in shorter time and thereby cheaper as change of ink colour can be performed more rapidly on a plant. It is thus advantageous to have a number of doctor blade chambers with each their ink colour whereby great flexibility is achieved. By this method it is only necessary with cleaning of the roller in connection with change of ink colour.

That the lid is provided with one or more carrying handles provides the advantage that the doctor blade chamber more or less automatically is carried in the correct position such that ink in the doctor blade chamber remains at the bottom of the doctor blade chamber. Such a lid can be fixed to the doctor blade chamber with various suitable locks or closures, and e.g. a simple box closing mechanism is suitable.

By a method according to the invention, the doctor blade chamber can be moved into position under the roller in different ways. From one side with a movement in longitudinal direction of the roller with an elevating movement in radial direction of the roller, or from a position along the roller by laterally displacing the doctor blade chamber.

Whether using one or the other way of bringing the doctor blade chamber into position under the roller before contact against is not important for the principle, but the said different ways may have each their advantage. For example, problems with space or other considerations to be taken may exist.

If the doctor blade chamber is to be moved into position under the roller from a position at one end of the roller with a movement in longitudinal direction of the roller, this operation may advantageously occur by placing the doctor blade chamber in a displaceable receiving drawer. Such a drawer may advantageously be adapted with a mounting groove for receiving guide pins or similar on the doctor blade chamber. When the drawer has been pushed in place, the doctor blade chamber is in position under the roller and may immediately be moved from the mounting groove of the drawer and into the mounting groove of the support holder, in which the doctor blade chamber can be moved to an operative position. It is therefore so that the grooves or the like in which the doctor blade chamber is placed in principle interact with mounting grooves in the support holder like a kind of point.

The same principle of interacting mounting grooves can be used if the doctor blade chamber is moved into position under the roller by an elevating movement in radial direction of the roller, where the doctor blade chamber is preferably disposed in an elevating receiving device, or if the doctor blade chamber is moved into position under the roller from a lateral position along the roller where the doctor blade chamber is placed on projecting receiver arms. Examples of different methods and apparatus designs will be discussed further in the detailed description.

BRIEF DESCRIPTION OF THE DRAWINGS

The invention is described in the following with reference to the drawing, wherein.

DETAILED DESCRIPTION OF THE INVENTION

Figure 1:
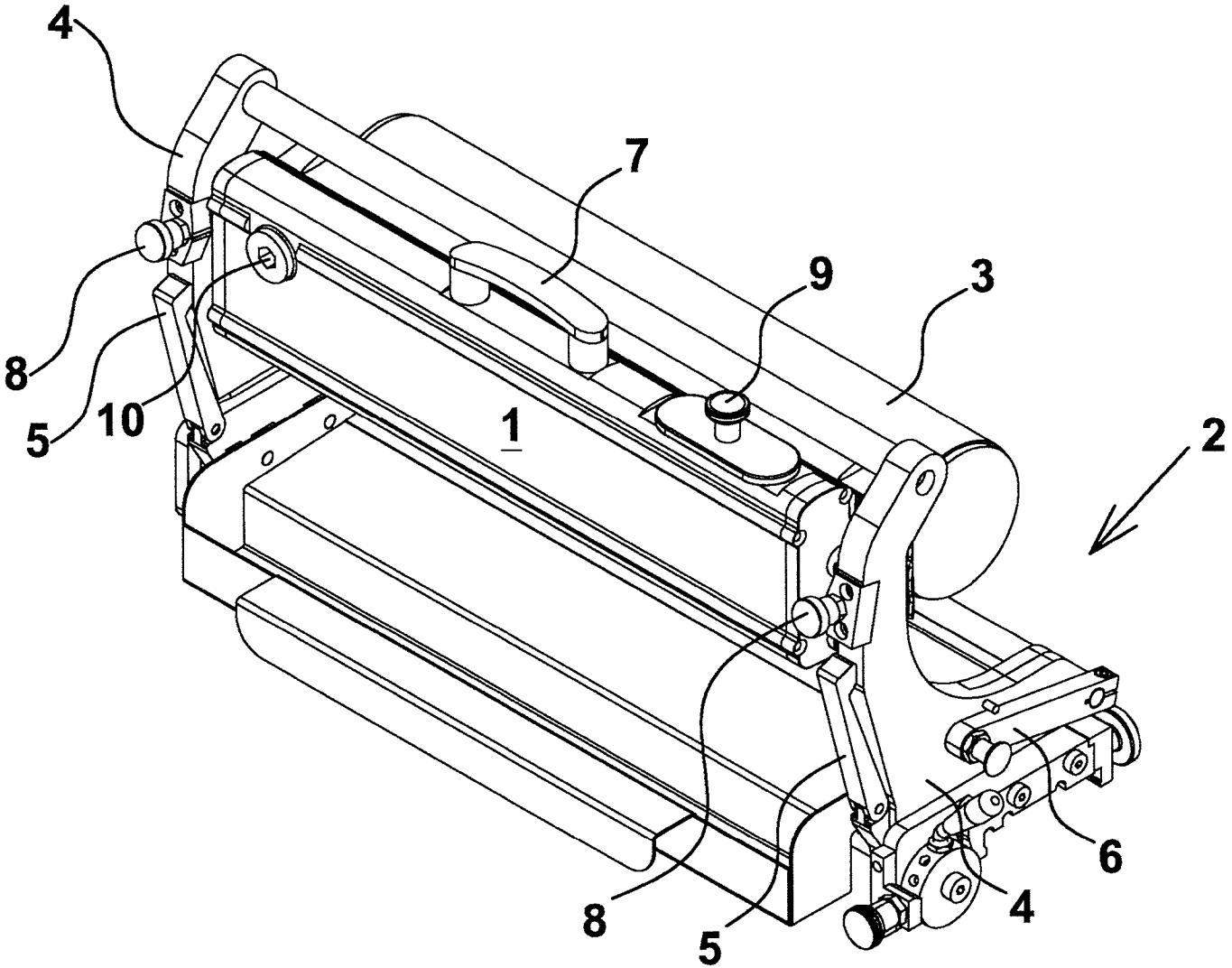
FIG. 1 shows a doctor blade chamber in operative position in a support holder.

In FIG. 1 appears a doctor blade chamber 1 mounted in a support holder 2 in position of operation at a roller 3. The support holder 2 is adapted with not shown mounting grooves in which not shown guide pins guide the doctor blade chamber 1. The support holder 2 in the shown variant includes two end pieces 4 where the said mounting grooves are on the internal side. This will appear from a subsequent figure. At the bottom of the support holder on the two end pieces 4 are seen unfolding receiver arms 5 upon which the doctor blade chamber 1 is disposed before being moved into the not shown mounting grooves. When the doctor blade chamber 1 is moved into position under the roller 2, the doctor blade chamber is elevated, and the doctor blades are brought into contact with the roller 3 by an operating handle 6.

The doctor blade chamber 1 is provided with a handle 7 which is used during moving from a position under the roller 3 to the shown operative position in which it is retained by a lock pin 8 at each end of the doctor blade chamber 1. A filling opening is provided at the upwardly facing edge of the doctor blade chamber 1, here closed by a tight-fitting plug 9. Moreover, in the doctor blade chamber 1 there is furthermore a plugged opening 10 for possible connection of an overflow tube or similar.

Figure 2:
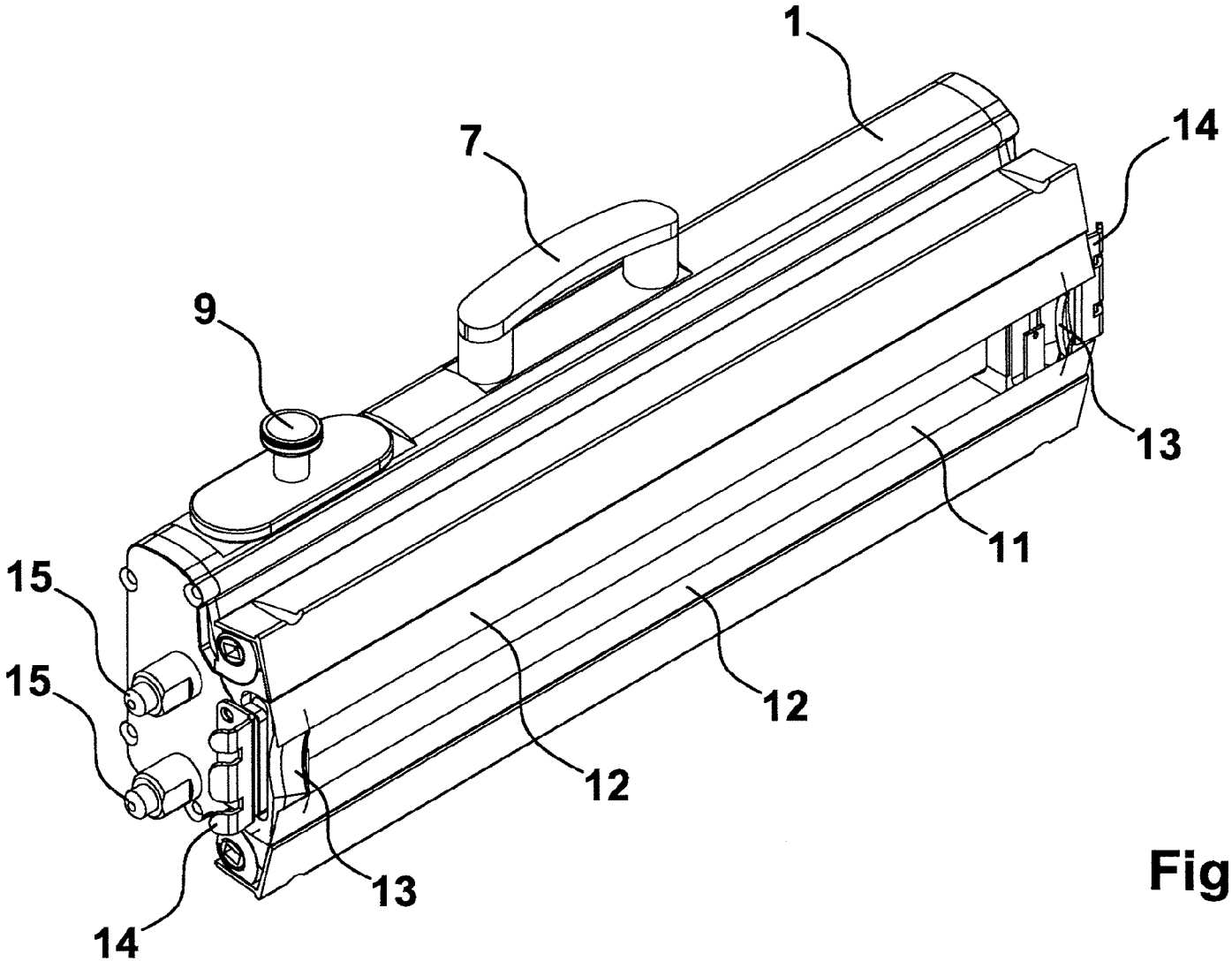
FIG. 2 shows a doctor blade chamber.

In FIG. 2 is seen a doctor blade chamber 1 where also the opening 11 between the doctor blades 12 and the sealings 13 at the ends of the doctor blade chamber are seen. Moreover appears a fitting 14 for fixing a lid above the opening 11 of the doctor blade chamber. At the ends of the doctor blade chamber are mounted guide pins 15, the purpose of which being to interact with corresponding mounting grooves in the support holder ends 4. In the shown embodiments, the guide pins 15 are provided with cylindric ends which by suitable tolerance fits into the said mounting grooves.

Figure 3:
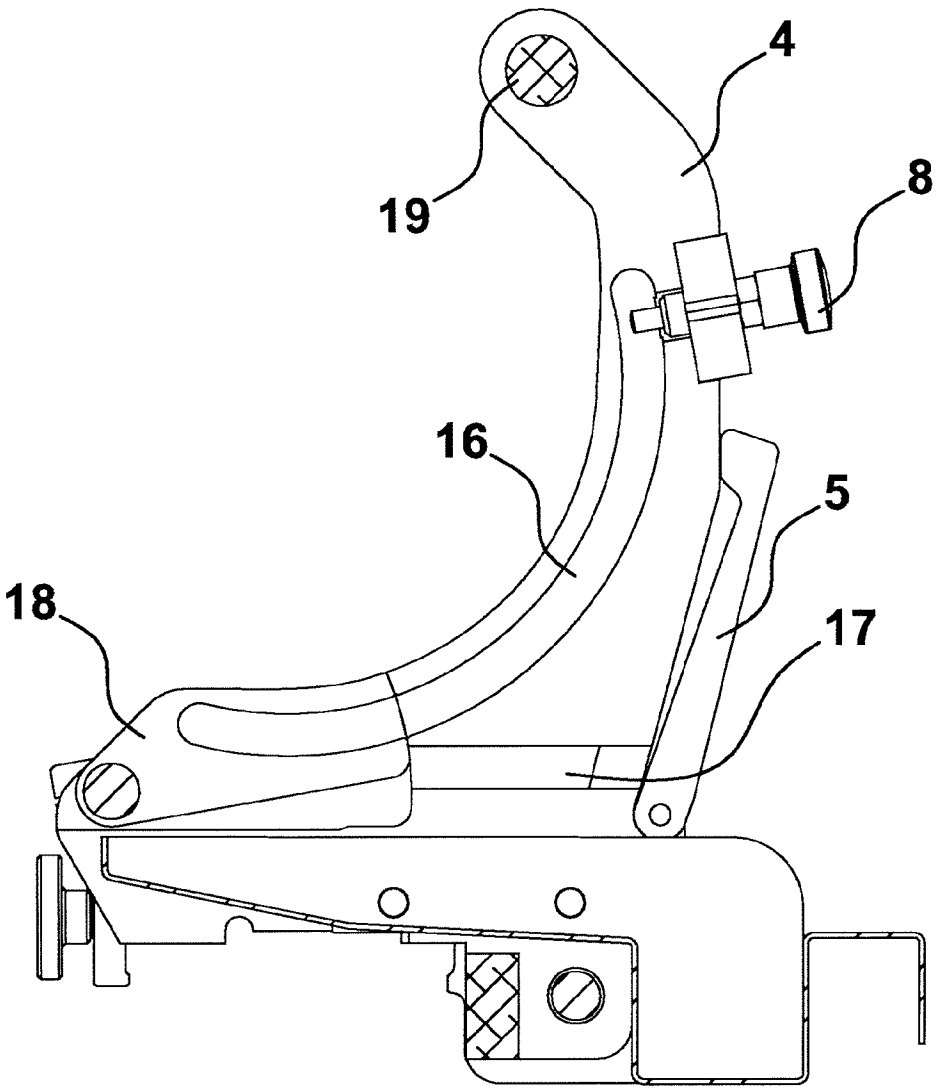
FIG. 3 shows the mounting groove in a support holder.

In FIG. 3 is seen an end piece 4 for a support holder 2 from the inner side, and the mentioned mounting groove 16 is now clearly seen. When the unfolding receiver arm 5 is folded down, this forms a plane connection to an inserting groove 17 which is connected to the mounting groove 16 by a point arrangement 18 which may be shifted between a receiving position and mounting position with the previously mentioned operation handle 6. Thus it is the operation handle 6 that is used for bringing the doctor blade chamber 1 into contact with the roller 3 before the doctor blade chamber 1 is moved from mounting position into operative position. The mounting groove 16 is part of a circle, the centre of which coinciding with the rotary axis of the roller. This causes the doctor blade chamber 1 to be pivoted up along the side of the roller 3 while being in contact with the surface of the roller, and such that it is moved without spilling ink from a mounting position to an operative position. At the top of the end piece 4 of the support holder is seen an opening 19 for receiving a not shown reinforcing connecting rod between the two end pieces 4.

Figure 4:
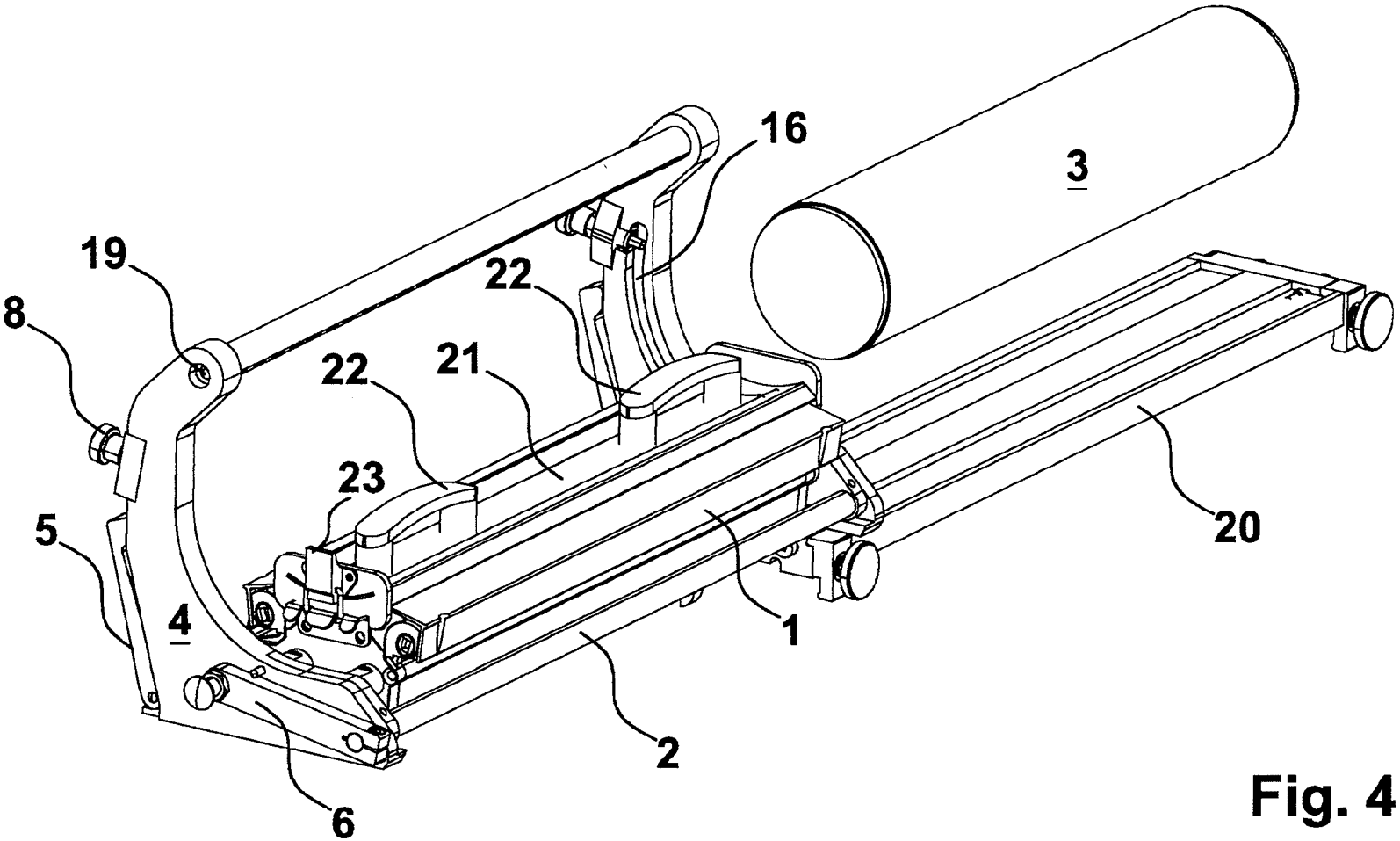
FIG. 4 shows a support holder in a step during mounting of a doctor blade chamber.

In FIG. 4 is seen a variant of invention where a support holder 2 is arranged longitudinally displacing on a lower part 20. This lower part 20 will be fixed to a larger machine structure which is not shown. On the outdrawn support holder 2 is disposed a doctor blade chamber 1 in mounting position, and the folding receiver arms 5 are folded up again. Over the hole 11 and between the doctor blades 12 is mounted a lid 21 with carrying handle 22. The lid 21 is fixed to fitting 14 on the doctor blade chamber with a simple lock mechanism 23.

Figure 5:
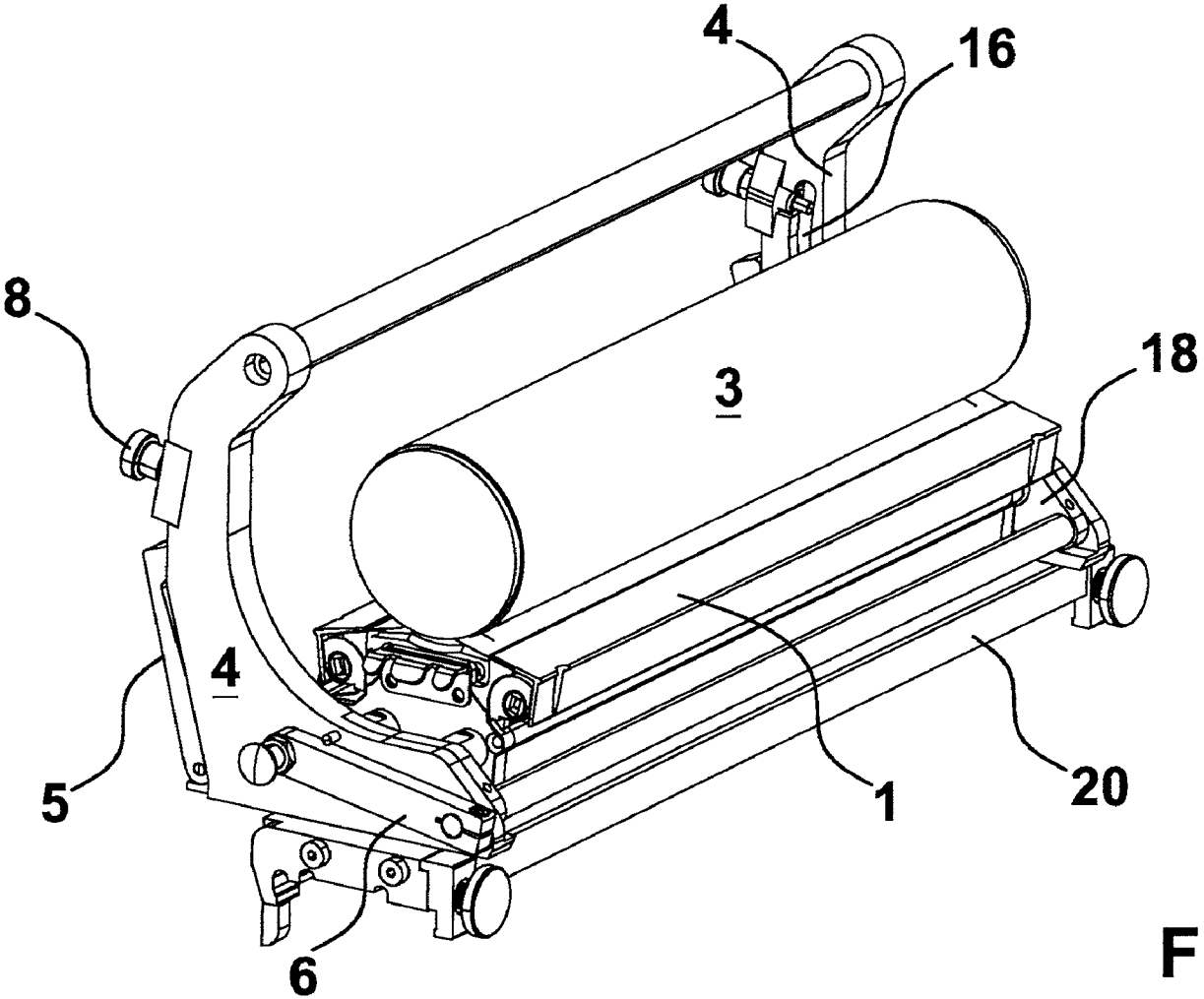
FIG. 5 shows a support holder in a second step during mounting of a doctor blade chamber.

Then the lid 21 is removed, and the doctor blade chamber 1 is pushed in under the roller 3 and is brought in contact with the roller 3, as seen in FIG. 5. The doctor blades 12 and the sealings 13 at the ends of the doctor blade chamber 1 are now in close contact with the roller 3, and the doctor blade chamber 1 may now be pivoted from the mounting position to a position of operation by means of the handle 7. This is feasible in that the doctor blade chamber is moved in the mounting groove 16 which has a rotary axis coinciding with the roller 3. During the pivoting of the doctor blade chamber 1 from mounting position to position of operation, the roller 3 may advantageously be freely rotating such that it 3 is just turned together with the doctor blade chamber 1.

Figure 6:
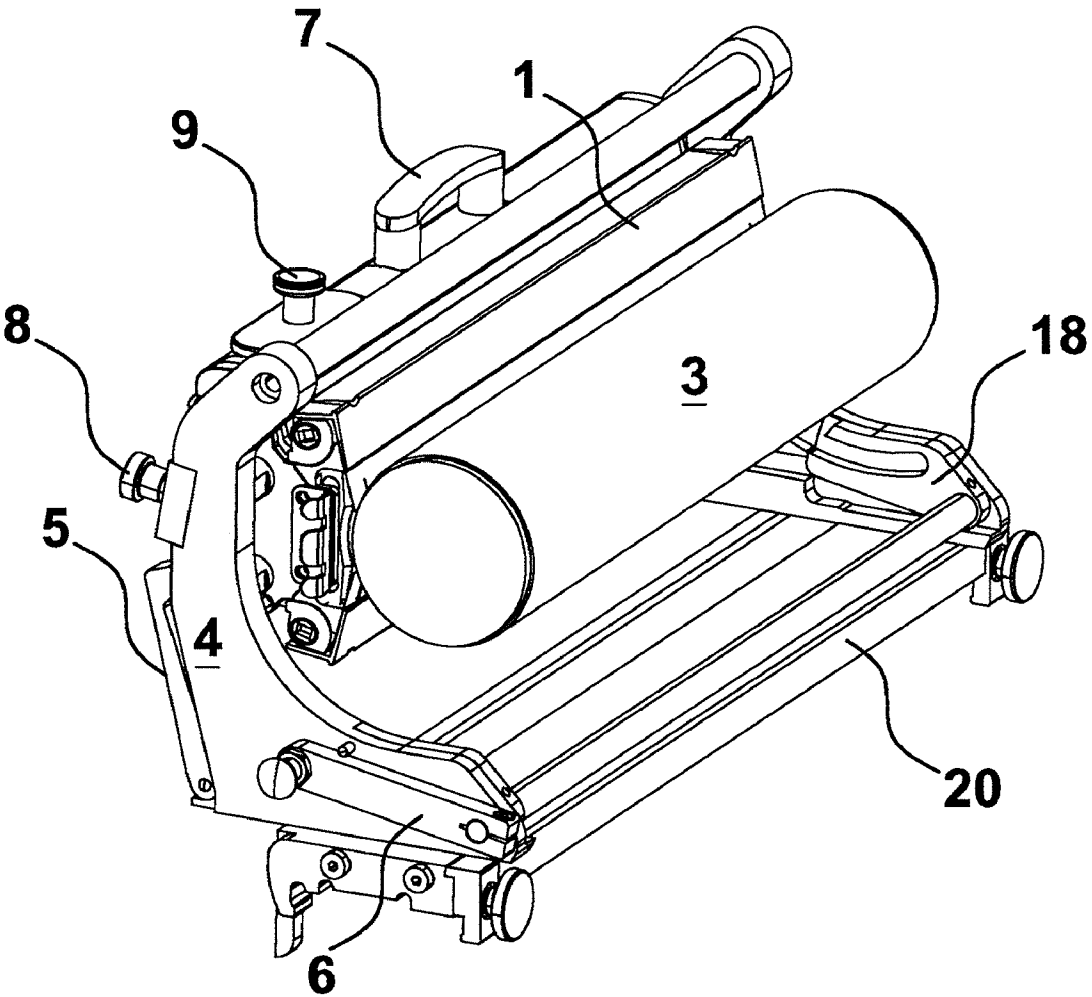
FIG. 6 shows a support holder in a third step during mounting of a doctor blade chamber.

FIG. 6 shows the doctor blade chamber in an operative position.

What is claimed is:

1. A method for mounting and dismounting a doctor blade chamber in a support holder on a printing unit, the printing unit having a roller for printing, the doctor blade chamber having an outlet opening and doctor blades for sealing the outlet opening against the roller and a bottom opposite the outlet opening, the method comprising the steps of placing the doctor blade chamber in the support holder in a mounting position in which the doctor blade chamber is disposed in a position under the roller with the outlet opening directed upwards and the doctor blades being out of contact with the roller then, with the doctor blade chamber in said mounting position, bringing the doctor blades into contact with the roller; and subsequently, while the doctor blades are in contact with the roller, pivoting the doctor blade chamber about an axis coinciding with an axis of rotation of the roller from the mounting position under the roller to a position of operation of the doctor blade chamber in which the ink flows by itself through the outlet opening towards the roller.

2. Method according to claim 1, wherein the doctor blade chamber is provided with guide pins, which interact with corresponding mounting grooves, in the support holder.

3. Method according to claim 1, wherein the doctor blade chamber is provided with a removable lid, that the lid is provided with a carrying handle and that the lid is used during transport and during storage of the doctor blade chamber.

4. Method according to claim 1, wherein the doctor blade chamber is moved into position under the roller from one side with a movement in longitudinal direction of the roller.

5. Method according to claim 1, wherein the doctor blade chamber is moved into position under the roller with an elevating movement in radial direction of the roller.

6. Method according to claim 1, wherein the doctor blade chamber is moved into position under the roller from a position alongside the roller in that the doctor blade chamber is laterally displaced.

7. A method according to claim 1, wherein the position of operation is at the side of the roller.

* * * * *